US011047226B2

(12) United States Patent
Du et al.

(10) Patent No.: US 11,047,226 B2
(45) Date of Patent: Jun. 29, 2021

(54) FLUID PRESSURE MEASURING DEVICE FOR MEASUREMENT-WHILE-DRILLING TOOL

(71) Applicant: Institute of Geology and Geophysics, Chinese Academy of Sciences, Beijing (CN)

(72) Inventors: Jiansheng Du, Beijing (CN); Qingyun Di, Beijing (CN); Zili Wang, Beijing (CN); Wenxuan Chen, Beijing (CN); Xinzhen He, Beijing (CN); Yongyou Yang, Beijing (CN)

(73) Assignee: Institute of Geology and Geophysics, Chinese Academy of Sciences, Beijing (CN)

( * ) Notice: Subject to any disclaimer, the term of this patent is extended or adjusted under 35 U.S.C. 154(b) by 151 days.

(21) Appl. No.: 16/516,497

(22) Filed: Jul. 19, 2019

(65) Prior Publication Data

US 2020/0208507 A1 Jul. 2, 2020

(30) Foreign Application Priority Data

Dec. 29, 2018 (CN) ..... 201811645018.1

(51) Int. Cl.
*E21B 47/01* (2012.01)
*E21B 47/017* (2012.01)
(Continued)

(52) U.S. Cl.
CPC ..... *E21B 47/01* (2013.01); *E21B 17/16* (2013.01); *E21B 47/017* (2020.05); *E21B 47/06* (2013.01)

(58) Field of Classification Search
CPC ..... E21B 47/01; E21B 47/013; E21B 47/017; E21B 47/06; E21B 49/003
See application file for complete search history.

(56) References Cited

U.S. PATENT DOCUMENTS 4,553,428 A * 11/1985 Upchurch ..... E21B 34/10 73/152.51
10,830,037 B2 * 11/2020 Du ..... G01V 1/52
2010/0111467 A1 * 5/2010 Vidal ..... G01K 11/3206 385/12

FOREIGN PATENT DOCUMENTS

CN 202483563 U 10/2012
CN 105484742 A 4/2016
CN 207245695 U 4/2018

OTHER PUBLICATIONS

Chinese Application No. 201811645018.1, Chinese Office Action dated Jul. 22, 2020, 8 pages.
(Continued)

*Primary Examiner* — Benjamin R Schmitt
(74) *Attorney, Agent, or Firm* — Zhong Law, LLC

(57) ABSTRACT

The disclosure relates to a fluid pressure measuring device for a measurement-while-drilling tool, which including a first sensor assembly (1), a second sensor assembly (2) and a sealing member (3), wherein a mounting groove (5) is formed on an outer side wall of a drill collar (4) of a measurement-while-drilling tool; the sealing member (3) is fixedly mounted on the mounting groove (5); a first liquid inlet hole (7) is formed in the sealing member (3); a second liquid inlet hole (9) communicated with a center flow channel (8) of the drill collar (4) is formed in the mounting groove (5); a liquid inlet end of the first sensor assembly (1) is communicated with the first liquid inlet hole (7); and a liquid inlet end of the second sensor assembly (2) is communicated with the second liquid inlet hole (9).

9 Claims, 4 Drawing Sheets

(51) Int. Cl.
*E21B 17/16* (2006.01)
*E21B 47/06* (2012.01)

(56) References Cited

OTHER PUBLICATIONS

Chinese Application No. 201811645018.1, Chinese Office Action dated Dec. 30, 2019, 14 pages.
Chinese Application No. 201811645018.1, Third Chinese Office Action dated Mar. 19, 2021, 9 pages.

* cited by examiner

FLUID PRESSURE MEASURING DEVICE FOR MEASUREMENT-WHILE-DRILLING TOOL

CROSS-REFERENCE TO RELATED APPLICATION

This application claims priority to Chinese Patent Application No. 201811645018.1 filed Dec. 29, 2018, the content of which is incorporated herein by reference in its entirety.

TECHNICAL FIELD

The present invention relates to a pressure measuring device, and more particularly, to a fluid pressure measuring device for measurement-while-drilling tool.

BACKGROUND

A drilling tool needs to send a pulse wave to the ground in real time when working underground. The pulse wave is generated by a liquid flows through an actuator. With the change of the drilling depth, different working conditions will appear, and the pressure and the flow rate of the liquid will change accordingly. The amplitude of the pulse wave may be impacted regardless of whether the flow rate increases or decreases. The amplitude of the pulse wave is weakened when the flow rate decreases, negatively impacting decoding by staff on the surface and increasing the difficulty of the decoding. Thus, in order to ensure the stability of the pulse wave, it is necessary to adjust an opening degree of the actuator. To this end, for obtaining the flow rate of the liquid to adjust the actuator, it is required to measure a pressure of the liquid inside a drill collar and a pressure of the liquid outside the drill collar. Therefore, it is necessary to design a device capable of measuring pressures inside and outside the drill collar simultaneously.

SUMMARY OF INVENTION

An object of the present invention is to provide a fluid pressure measuring device for measurement-while-drilling tool which can overcome deficiencies in the prior art by measuring the pressure inside and outside the drill collar in real time.

The present invention provides a fluid pressure measuring device for a measurement-while-drilling tool, including a first sensor assembly, a second sensor assembly and a sealing member, wherein a mounting groove is formed on an outer side wall of a drill collar of the measurement-while-drilling tool; the sealing member is fixedly mounted on the mounting groove; both the first sensor assembly and the second sensor assembly are fixedly mounted in the mounting groove; a first liquid inlet hole is formed in the sealing member; a second liquid inlet hole communicated with a center flow channel of the drill collar is formed in the mounting groove; a liquid inlet end of the first sensor assembly is communicated with the first liquid inlet hole; and a liquid inlet end of the second sensor assembly is communicated with the second liquid inlet hole.

In the foregoing fluid pressure measuring device for the measurement-while-drilling tool, preferably, the mounting groove includes a first groove body and a second groove body, and the second groove body is formed at the bottom of the first groove body; the sealing member includes a cover plate portion and a limiting portion which are of an integrated structure; the shape and size of the cover plate portion is identical to the first groove body; and the shape and size of the limiting portion is identical to the second groove body; a stepped hole is formed in each of the two ends of the cover plate portion; threaded holes corresponding to the stepped holes are formed in the first groove body.

In the foregoing fluid pressure measuring device for the measurement-while-drilling tool, preferably, at least two disassembling holes which are blind holes are formed on the top of the cover plate portion.

In the foregoing fluid pressure measuring device for the measurement-while-drilling tool, preferably, a sealing ring is arranged on an outer wall of the limiting portion.

In the foregoing fluid pressure measuring device for the measurement-while-drilling tool, preferably, a first lower holding groove and a second lower holding groove are formed at the bottom of the second groove body; a first upper holding groove and a second upper holding groove are formed at the bottom of the limiting portion; the first upper holding groove corresponds to the first lower holding groove, and the first sensor assembly is mounted in a space formed by the first upper holding groove and the first lower holding groove; the second upper holding groove corresponds to the second lower holding groove, and the second sensor assembly is mounted in a space formed by the second upper holding groove and the second lower holding groove;

One end of the first liquid inlet hole is located in the first upper holding groove, and the other end of the first liquid inlet hole extends to the surface of the cover plate portion to be communicated to the outside;

One end of the second liquid inlet hole is located in the second lower holding groove, and the other end of the second liquid inlet hole is communicated with the center flow channel.

In the foregoing fluid pressure measuring device for the measurement-while-drilling tool, preferably, further includes a communicating groove and a wire harness hole, wherein the communicating groove is formed in the second groove body, and the communicating groove is configured to communicate the first lower holding groove with the second lower holding groove; and one end of the wire harness hole is located in the communicating groove, and the other end of the wire harness hole is communicated with a wire routing hole of the drill collar.

In the foregoing fluid pressure measuring device for the measurement-while-drilling tool, preferably, a first locating hole(s) is/are formed in the first upper holding groove or/and the first lower holding groove; a second locating hole(s) is/are formed in the second upper holding groove or/and the second lower holding groove; a first locating pin matched with the first locating hole is arranged on the first sensor assembly; and a second locating pin matched with the second locating hole is arranged on the second sensor assembly.

In the foregoing fluid pressure measuring device for the measurement-while-drilling tool, preferably, the structure of the first sensor assembly is identical to the second sensor assembly, each sensor assembly including a sheath, a connector and a sensor, wherein a first mounting hole is radially formed in a side wall of one end of the sheath; a second mounting hole is axially formed in the other end of the sheath; the first mounting hole and the second mounting hole are communicated through a flow channel; one end of the connector is fixedly mounted in the first mounting hole; and the sensor is fixedly mounted in the second mounting hole.

In the foregoing fluid pressure measuring device for the measurement-while-drilling tool, preferably, an inner wall of an opening end of the second mounting hole is provided with a circular groove in which a limiting circlip is mounted.

In the foregoing fluid pressure measuring device for the measurement-while-drilling tool, preferably, an outer wall of the sensor is provided with a limiting hole; a through hole is formed in the sheath; after the sensor is installed in the second mounting hole, the limiting hole is opposite to the through hole; and a limiting pin matched with the limiting hole is mounted in the through hole.

Compared with the prior art, in the present invention, the mounting groove is formed in the outer side wall of the drill collar, and the sealing member is fixed in the mounting groove of the drill collar by bolts, which is convenient for installation and disassembly. The first sensor assembly and the second sensor assembly are arranged in the mounting groove, and the pressure of the liquid outside the drill collar can be measured by the first sensor assembly, and the pressure of the liquid inside the drill collar can be measured by the second sensor assembly, thereby solving the deficiencies of the prior art. The sealing member is radially mounted and fixed in the present invention, so that the sealing reliability is effectively improved, and the normal operation of the device is ensured.

The reference signs represent the following components: 1—first sensor assembly, 2—second sensor assembly, 3—sealing member, 4—drill collar, 5—mounting groove, 6—bolt, 7—first liquid inlet hole, 8—center flow channel, 9—second liquid inlet hole, 10—first groove body, 11—second groove body, 12—cover plate portion, 13—limiting portion, 14—stepped hole, 15—threaded hole, 16—disassembling hole, 17—sealing ring, 18—first lower holding groove, 19—second lower holding groove, 20—first upper holding groove, 21—second upper holding groove, 22—communicating groove, 23—wire harness hole, 24—wire routing hole, 25—first locating hole, 26—second locating hole, 27—first locating pin, 28—second locating pin, 29—sheath, 30—connector, 31—limiting circlip, 32—sensor, 33—first mounting hole, 34—second mounting hole, 35—flow channel, 36—circular groove, 38—through hole, 39—limiting pin.

DESCRIPTION OF EMBODIMENTS

The embodiments described with reference to the drawings below are only exemplary, and are only intended to explain rather than limit the present invention.

Figure 1:
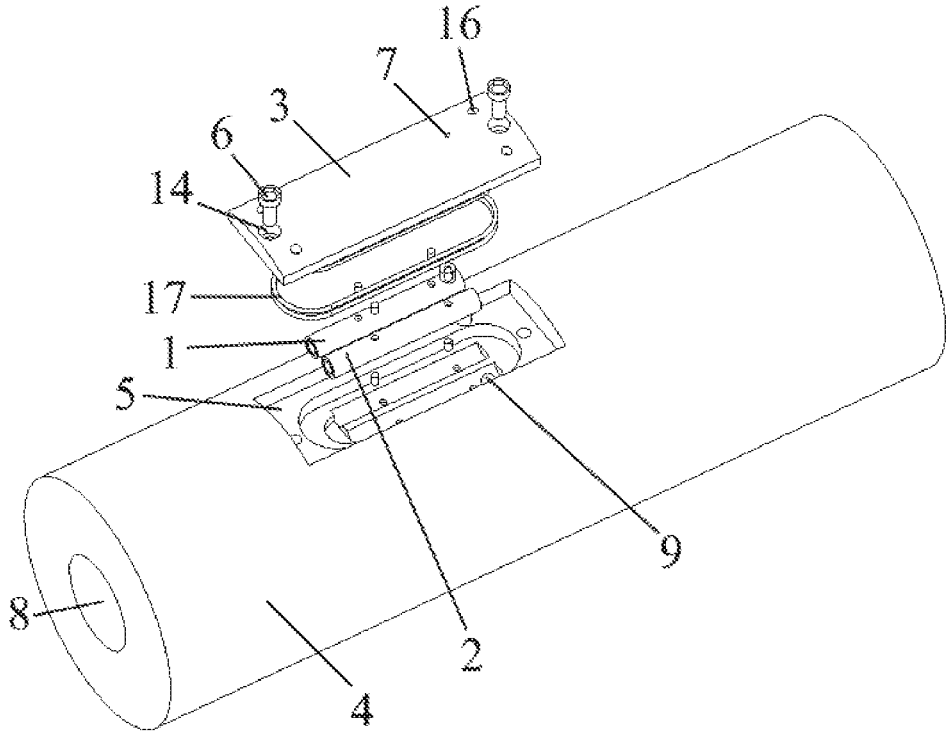
FIG. 1 is an exploded view of an overall structure of the present invention.

According to an embodiment of the present invention, as shown in FIG. 1, a fluid pressure measuring device for a measurement-while-drilling tool includes: a first sensor assembly 1, a second sensor assembly 2 and a sealing member 3. A mounting groove 5 is formed on the outer side wall of a drill collar 4 of a measurement-while-drilling tool. The sealing member 3 is fastened onto the mounting groove 5 and fixed through bolts 6. It should be noted that the actual length of the drill collar 4 can be very long, and FIG. 1 only shows a structural section of the drill collar 4. As the drill collar works in mud, the sealing member 3 and the mounting groove 5 are necessarily mounted in a sealed manner, whereas a sealing structure employed will be specifically described in the following embodiments. Both the first sensor assembly 1 and the second sensor assembly 2 are fixedly mounted in the mounting groove 5. A first liquid inlet hole 7 is formed in the sealing member 3. A second liquid inlet hole 9 communicated with a center flow channel 8 of the drill collar 4 is formed in the mounting groove 5. A liquid inlet end of the first sensor assembly 1 is communicated with the first liquid inlet hole 7; and a liquid inlet end of the second sensor assembly 2 is communicated with the second liquid inlet hole 9.

When in operation, the mud (fluid) outside the drill collar enters the first sensor assembly 1 through the first liquid inlet hole 7 in the sealing member 3, and the first sensor assembly 1 measures the pressure of the mud outside the drill collar 4. The mud inside the drill collar 4 flows in the center flow channel 8, and enters the second sensor assembly 2 through the second liquid inlet hole 9, and the second sensor assembly 2 measures the pressure of the mud in the center flow channel 8, i.e., the pressure of the mud inside the drill collar 4. It should be noted that the first sensor assembly 1 and the second sensor assembly 2 can adopt a wired structure or a wireless structure. The wired structure transmits the collected pressure data to a controller through a data line, and the wireless structure sending the collected data to the controller through a wireless signal. In order to ensure the stability and accuracy in data transmission, the present embodiment preferably adopts the wired structure which will be specifically described below.

Figure 3:
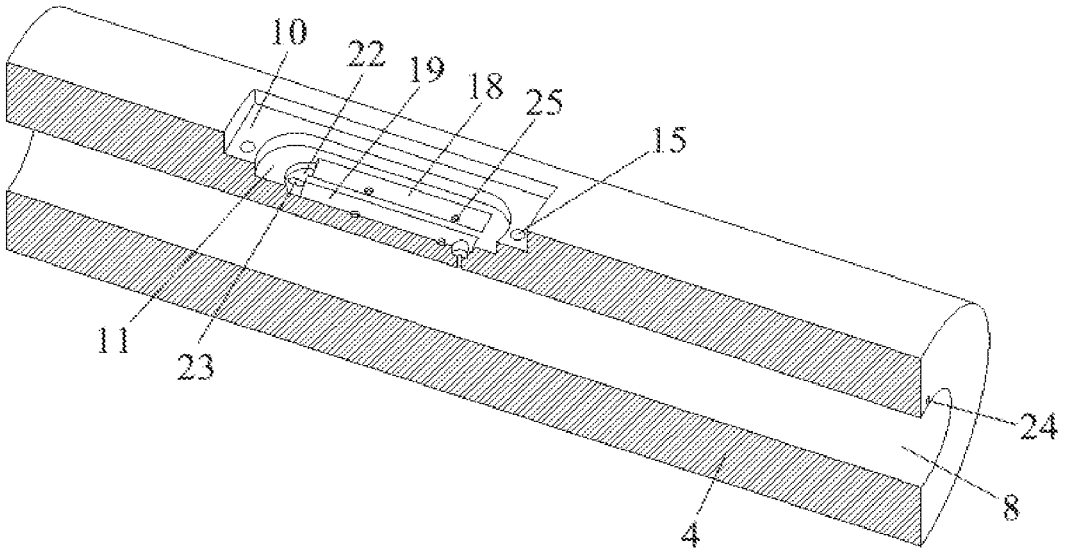
FIG. 3 is an axonometric view of the drill collar after being partially sectioned.
Figure 4:
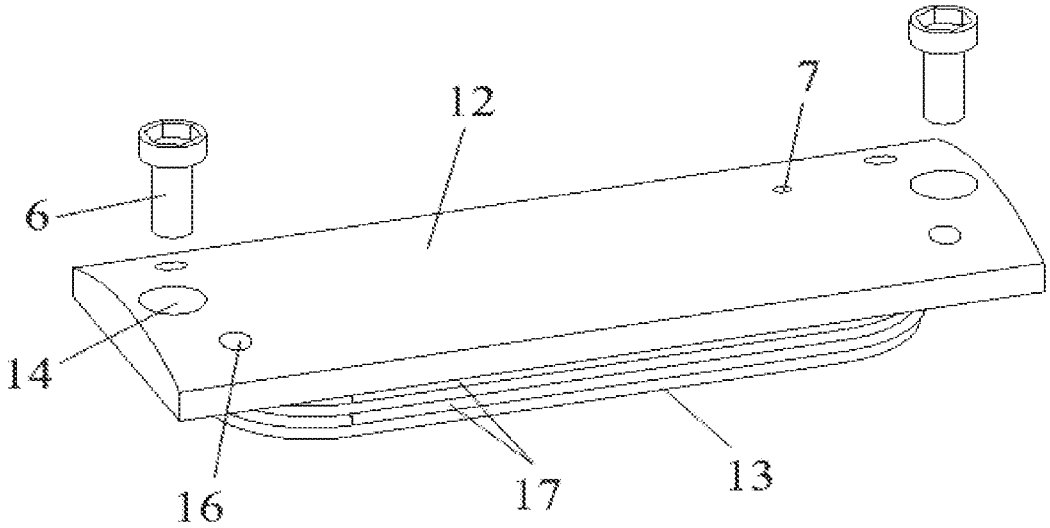
FIG. 4 is an axonometric view of the sealing member and bolts.

In a specific embodiment, as shown in FIG. 3, the mounting groove 5 includes a first groove body 10 and a second groove body 11, and the second groove body 11 is formed at the bottom of the first groove body 10. Referring to FIG. 4, the sealing member 3 includes a cover plate portion 12 and a limiting portion 13 which are of an integrated structure. The shape and size of the cover plate portion 12 is identical to the first groove body 10; and the shape and size of the limiting portion 13 is identical to the second groove body 11. A stepped hole 14 is formed in each of the two ends of the cover plate portion 12. Threaded holes 15 related to the stepped holes 14 are formed in the first groove body 10. A sealing ring 17 is arranged on the outer wall of the limiting portion 13. It should be noted that the shape of the first groove body 10 and the second groove body 11 need not be specifically limited as long as they meet the use requirements. In the present embodiment, preferably, the first groove body 10 is a rectangular groove, and the second groove body 11 is a groove with a rectangular middle portion and two semicircular ends. The sealing ring 17 on the outer wall of the limiting portion 13 acts as a seal to prevent the mud outside the drill collar 4 from entering the second groove body 11. Once the mud enters the second groove body 11, the normal operation of the first sensor assembly 1 and the second sensor assembly 2 will be adversely affected. Of course, the sealing ring 17 may also be arranged on the side wall of the second groove body 11. In order to improve the sealing effect, other sealing rings may be arranged on the top surface of the first groove body 10 or the bottom surface of the cover plate portion 12.

In addition, the drill collar 4 is rotated at a high speed during operation, so that the top surface of the cover plate portion 12 preferably adopts an arc-shaped surface. That is, after the cover plate portion 12 is mounted and fixed, the cover plate portion 12 and the drill collar 4 constitute a complete cylinder. In this way, during operation, the edge of the cover plate portion 12 is prevented from scouring by the mud, effectively protecting the sealing member 3. It is understandable that this structure is inconvenient to disassemble. For this reason, as shown in FIG. 4, at least two disassembling holes 16 are formed on the top of the cover plate portion 12. In the present embodiment, preferably, there are four disassembling holes 16 which are formed in four corners of the cover plate portion 12 respectively and which are blind holes. With the disassembling holes 16, the sealing member 3 can be easily disassembled using a tool.

In order to ensure the normal operation of the sensor, the liquid (mud) should not enter the second groove body 11. Thus, it is critical to ensure the efficient sealing. Specifically, referring to FIG. 3 and FIG. 5, a first lower holding groove 18 and a second lower holding groove 19 are formed at the bottom of the second groove body 11. A first upper holding groove 20 and a second upper holding groove 21 are formed at the bottom of the limiting portion 13. The first upper holding groove 20 corresponds to the first lower holding groove 18, and the first sensor assembly 1 is mounted in a space formed by the first upper holding groove 20 and the first lower holding groove 18. The second upper holding groove 21 corresponds to the second lower holding groove 19, and the second sensor assembly 2 is mounted in a space formed by the second upper holding groove 21 and the second lower holding groove 19. One end of the first liquid inlet hole 7 is located in the first upper holding groove 20, and the other end of the first liquid inlet hole 7 extends to the surface of the cover plate portion 12 to be communicated to the outside. One end of the second liquid inlet hole 9 is located in the second lower holding groove 19, and the other end of the second liquid inlet hole 9 is communicated with the center flow channel 8.

Figure 2:
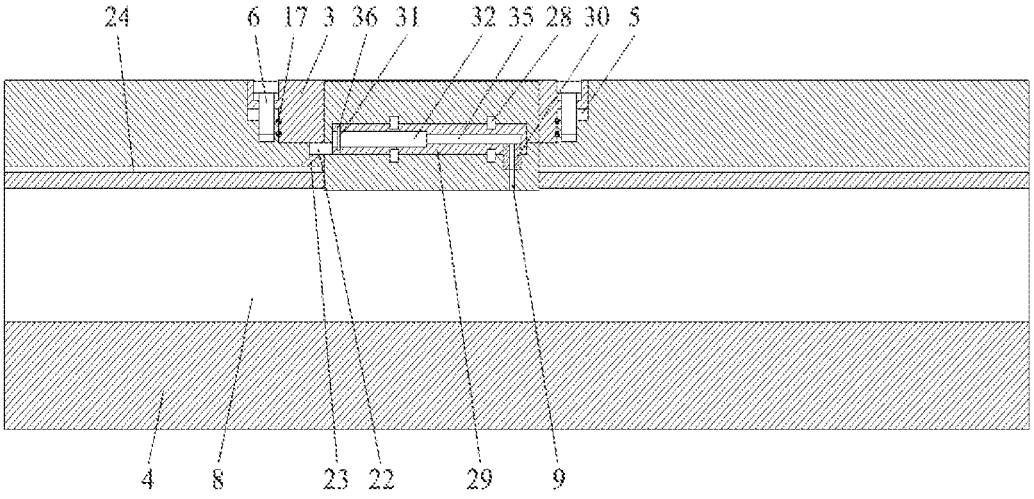
FIG. 2 is a cross-sectional view of the overall structure of the present invention.
Figure 7:
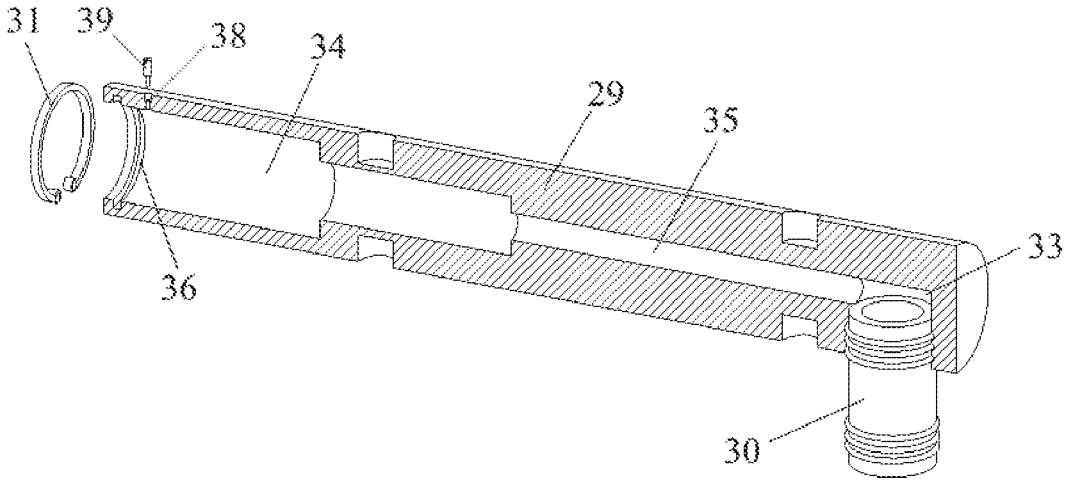
FIG. 7 is an axonometric view of the sheath after being sectioned in half.

As shown in FIG. 2 and FIG. 7, the structure of the first sensor assembly 1 is the same as the second sensor assembly 2, each assembly including a sheath 29, a connector 30, and a sensor 32. A first mounting hole 33 is radially formed in a side wall of one end of the sheath 29. A second mounting hole 34 is axially formed in the other end of the sheath 29. The first mounting hole 33 and the second mounting hole 34 are communicated through a flow channel 35. One end of the connector 30 is fixedly mounted in the first mounting hole 33, and the sensor 32 is fixedly mounted in the second mounting hole 34. The sheath 29 is preferably made of an insulating waterproof material. In this way, even if the liquid accidentally enters the second groove body 11, the sheath 29 protects the sensor 32 from short circuit, thereby ensuring the normal operation of the sensor 32. Preferably, sealing rings is arranged at each of the two ends of the connector 30 to prevent the liquid from leaking from the connector 30.

As the liquid (mud) is in contact with a sensing end of the sensor 32, the sensing end of the sensor 32 and the sheath 29 should be mounted in a sealed manner. To prevent the sensor 32 from swinging, preferably, the inner wall of an opening end of the second mounting hole 34 is provided with a circular groove 36 in which a limiting circlip 31 is mounted. The sensor 32 can be fixed by the limiting circlip 31. Further, more preferably, the outer wall of the sensor 32 is provided with a limiting hole. A through hole 38 is formed in the sheath 29. After the sensor 32 is installed in the second mounting hole 32, the limiting hole is opposite to the through hole 38. A limiting pin 39 matched with the limiting hole is mounted in the through hole 38. The sensor 32 can be further positioned by the limiting pin 39, so that axial movement of the sensor 32 is prevented.

Figure 5:
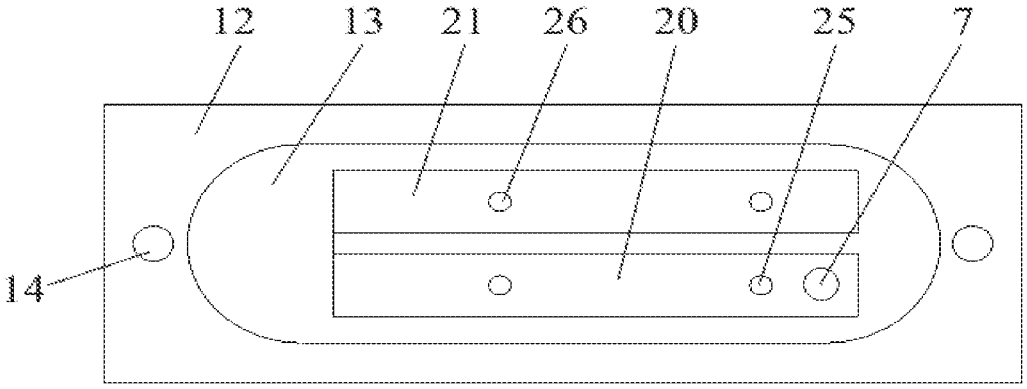
FIG. 5 is a bottom view of the sealing member.
Figure 6:
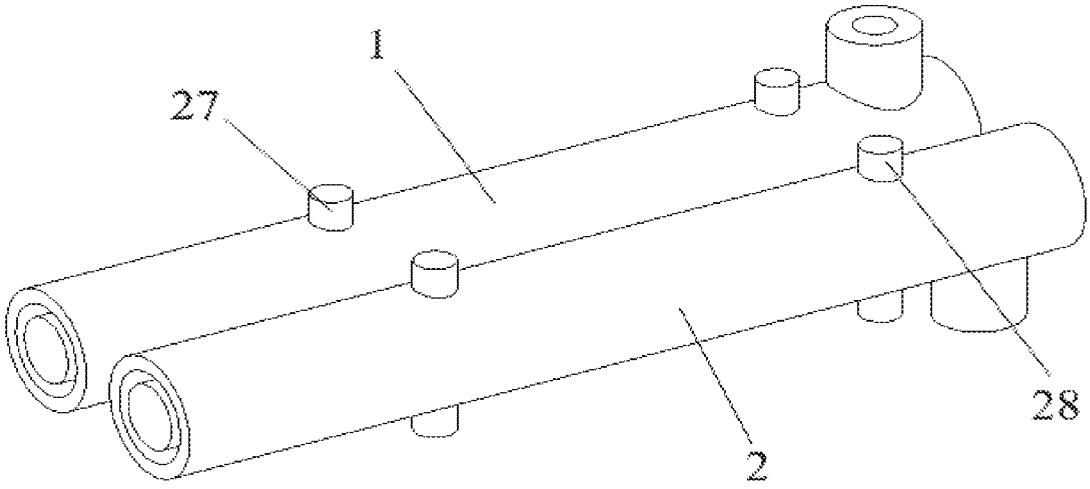
FIG. 6 is an axonometric view of the first sensor assembly and the second sensor assembly.

Since sealing is critical, the mud should be prevented from leaking from a joint between the connector 30 and the first liquid inlet hole 7 and a joint between the connector 30 and the second liquid inlet hole 9, in addition to preventing the mud from leaking from the inside of the sensor assembly. As shown in FIG. 3, FIG. 5 and FIG. 6, a first locating hole(s) 25 is/are formed in the first upper holding groove 20 or/and the first lower holding groove 18. A second locating hole(s) 26 is/are formed in the second upper holding groove 21 or/and the second lower holding groove 19. A first locating pin 27 matched with the first locating hole 25 is arranged on the first sensor assembly 1. A second locating pin 28 matched with the second locating hole 26 is arranged on the second sensor assembly 2.

The first sensor assembly 1 and the second sensor assembly 2 can be effectively positioned through the first locating hole 25, the second locating hole 26, the first locating pin 27 and the second locating pin 28, so that the effective sealing effect at the joints of the connector 30 is ensured, thereby preventing leakage.

It is mentioned in the above embodiments that the first sensor assembly 1 and the second sensor assembly 2 preferably adopt the wired structure. That is, a signal output end of the sensor 32 needs to be connected to the data line. Thus, it is necessary to arrange a space for holding the data line. As shown in FIGS. 2 and 3, the fluid pressure measuring device for the measurement-while-drilling tool further includes a communicating groove 22 and a wire harness hole 23. The communicating groove 22 is formed in the second groove body 11, and the communicating groove 22 is configured to communicate the first lower holding groove 18 with the second lower holding groove 19. One end of the wire harness hole 23 is located in the communicating groove 22, and the other end of the wire harness hole 23 is communicated with the wire routing hole 24 of the drill collar 4.

The structures, features and effects of the present invention are described in detail in the above embodiments with reference to the drawings, but they only show the preferred embodiments of the present invention, and the drawings shall not define the application scope of the present invention. The variations made according to the concept of the present invention, or the equivalent embodiments including equivalent modifications within the scope of the description and the drawings shall fall into the protection scope of the present invention.

The invention claimed is:

1. A fluid pressure measuring device for a measurement-while-drilling tool, comprising: a first sensor assembly (1), a second sensor assembly (2) and a sealing member (3), wherein a mounting groove (5) is formed on an outer side wall of a drill collar (4) of a measurement-while-drilling tool; the sealing member (3) is fixedly mounted on the mounting groove (5); both the first sensor assembly (1) and the second sensor assembly (2) are fixedly mounted in the mounting groove (5); a first liquid inlet hole (7) is formed in the sealing member (3); a second liquid inlet hole (9) communicated with a center flow channel (8) of the drill collar (4) is formed in the mounting groove (5); a liquid inlet end of the first sensor assembly (1) is communicated with the first liquid inlet hole (7); and a liquid inlet end of the second sensor assembly (2) is communicated with the second liquid inlet hole (9), wherein the mounting groove (5) comprises a first groove body (10) and a second groove body (11), and the second groove body (11) is formed at the bottom of the first groove body (10); the sealing member (3) includes a cover plate portion (12) and a limiting portion (13) which are of an integrated structure; the shape and size of the cover plate portion (12) is the same as the first groove body (10); the shape and size of the limiting portion (13) is the same as the second groove body (11); a stepped hole (14) is formed in each of the two ends of the cover plate portion (12); threaded holes (15) corresponding to the stepped holes (14) are formed in the first groove body (15).

2. The fluid pressure measuring device for the measurement-while-drilling tool of claim 1, wherein at least two disassembling holes (16) which are blind holes are formed on the top of the cover plate portion (12).

3. The fluid pressure measuring device for the measurement-while-drilling tool of claim 1, wherein a sealing ring (17) is arranged on an outer wall of the limiting portion (13).

4. The fluid pressure measuring device for the measurement-while-drilling tool of claim 1, wherein a first lower holding groove (18) and a second lower holding groove (19) are formed at the bottom of the second groove body (11); a first upper holding groove (20) and a second upper holding groove (21) are formed at the bottom of the limiting portion (13); the first upper holding groove (20) corresponds to the first lower holding groove (18); the first sensor assembly (1) is mounted in a space formed by the first upper holding groove (20) and the first lower holding groove (18); the second upper holding groove (21) corresponds to the second lower holding groove (19); and the second sensor assembly (2) is mounted in a space formed by the second upper holding groove (21) and the second lower holding groove (19);

one end of the first liquid inlet hole (7) is located in the first upper holding groove (20), and the other end of the first liquid inlet hole (7) extends to the surface of the cover plate portion (12) to be communicated to the outside; and one end of the second liquid inlet hole (9) is located in the second lower holding groove (19), and the other end of the second liquid inlet hole (9) is communicated with the center flow channel (8).

5. The fluid pressure measuring device for the measurement-while-drilling tool of claim 4, further comprising a communicating groove (22) and a wire harness hole (23), wherein the communicating groove (22) is formed in the second groove body (11), and the communicating groove (22) is configured to communicate the first lower holding groove (18) with the second lower holding groove (19); and one end of the wire harness hole (23) is located in the communicating groove (22), and the other end of the wire harness hole (23) is communicated with a wire routing hole (24) of the drill collar (4).

6. The fluid pressure measuring device for the measurement-while-drilling tool of claim 4, wherein a first locating hole(s) (25) is/are formed in the first upper holding groove (20) or/and the first lower holding groove (18); a second locating hole(s) (26) is/are formed in the second upper holding groove (21) or/and the second lower holding groove (19); a first locating pin (27) matched with the first locating hole (25) is arranged on the first sensor assembly (1); and a second locating pin (28) matched with the second locating hole (26) is arranged on the second sensor assembly (2).

7. The fluid pressure measuring device for the measurement-while-drilling tool of claim 6, wherein, the structure of the first sensor assembly (1) is the same as the second sensor assembly (2), each of the first sensor assembly and the second sensor assembly respectively comprising a sheath (29), a connector (30) and a sensor (32); a first mounting hole (33) is radially formed in a side wall of one end of the sheath (29); a second mounting hole (34) is axially formed in the other end of the sheath (29); the first mounting hole (33) and the second mounting hole (34) are communicated through a flow channel (35); one end of the connector (30) is fixedly mounted in the first mounting hole (33); and the sensor (32) is fixedly mounted in the second mounting hole (34).

8. The fluid pressure measuring device for the measurement-while-drilling tool of claim 7, wherein an inner wall of an opening end of the second mounting hole (34) is provided with a circular groove (36) in which a limiting circlip (31) is mounted.

9. The fluid pressure measuring device for the measurement-while-drilling tool of claim 7, wherein an outer wall of the sensor (32) is provided with a limiting hole; a through hole (38) is formed in the sheath (29); after the sensor (32) is installed in the second mounting hole (34), the limiting hole is opposite to the through hole (38); and a limiting pin (39) matched with the limiting hole is mounted in the through hole (38).

* * * * *